US008558757B2

(12) United States Patent
Lee et al.

(10) Patent No.: US 8,558,757 B2
(45) Date of Patent: Oct. 15, 2013

(54) DISPLAY SYSTEM

(75) Inventors: Dong-hoon Lee, Seoul (KR); Young-chan Kim, Euiwang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1383 days.

(21) Appl. No.: 10/986,321

(22) Filed: Nov. 12, 2004

(65) Prior Publication Data

US 2005/0156933 A1 Jul. 21, 2005

(30) Foreign Application Priority Data

Jan. 19, 2004 (KR) ..... 10-2004-0003938

(51) Int. Cl.
*G09G 5/00* (2006.01)

(52) U.S. Cl.
USPC ..... 345/2.1

(58) Field of Classification Search
USPC ..... 345/3.1, 156, 184, 204, 520, 522, 690, 345/698, 1.1, 2.3, 2.1; 710/129, 63; 715/762–764; 717/11; 709/223; 348/184; 725/40, 51; 700/83
See application file for complete search history.

(56) References Cited

U.S. PATENT DOCUMENTS

| | | | | |
|---|---|---|---|---|
| 6,078,361 | A * | 6/2000 | Reddy | 348/558 |
| 6,208,326 | B1 | 3/2001 | Frederick | |
| 6,314,479 | B1 * | 11/2001 | Frederick et al. | 710/63 |
| 6,326,935 | B1 * | 12/2001 | Boger | 345/3.2 |
| 6,456,892 | B1 * | 9/2002 | Dara-Abrams et al. | 700/83 |
| 6,546,419 | B1 * | 4/2003 | Humpleman et al. | 715/733 |
| 6,552,738 | B1 | 4/2003 | Lin et al. | |
| 6,577,301 | B1 | 6/2003 | Tsai | |
| 6,618,773 | B1 | 9/2003 | Chang | |
| 6,839,055 | B1 * | 1/2005 | Nguyen | 345/204 |
| 6,845,277 | B1 * | 1/2005 | Michelet et al. | 700/83 |
| 7,009,616 | B2 * | 3/2006 | Mendelson et al. | 345/519 |
| 7,138,989 | B2 * | 11/2006 | Mendelson et al. | 345/204 |
| 7,496,945 | B2 * | 2/2009 | Rodriguez | 725/51 |
| 2003/0001829 | A1 | 1/2003 | Tanizoe et al. | |
| 2004/0162912 | A1 * | 8/2004 | Taraci | 705/22 |

FOREIGN PATENT DOCUMENTS

| | | |
|---|---|---|
| JP | H11-15425 | 5/1989 |
| JP | 10-275074 | 10/1998 |
| JP | H13-175398 | 6/2001 |
| JP | 2001-202068 | 7/2001 |

(Continued)

OTHER PUBLICATIONS

Korean Office Action issued in corresponding Korean Application No. 2004-3938.

(Continued)

*Primary Examiner* — Kevin M Nguyen
(74) *Attorney, Agent, or Firm* — Stanzione & Kim, LLP

(57) ABSTRACT

A display system including a display having a interface unit to provide bi-directional communication, a display unit to show an image, a signal processor to convert an image signal inputted through the interface unit to a signal being displayed by the display unit, and a MICOM to output a display information of a controllable functions over the display unit and the signal processor through the interface unit; and a controller connected to the interface unit and providing a graphic user interface corresponding to the display information received from the display and having a display controller to output a control instruction that the MICOM allows to control at least, one of the display unit and the signal processor according to setting through the graphic user interface, to the MICOM through the interface unit.

30 Claims, 5 Drawing Sheets

(56) References Cited

FOREIGN PATENT DOCUMENTS

| | | | |
|---|---|---|---|
| JP | 2002-023715 | | 1/2002 |
| JP | 2002-23715 | | 1/2002 |
| KR | 10-141750 | | 3/1998 |
| KR | 1998-44469 | | 9/1998 |
| KR | 2001-96970 | A | 11/2001 |
| KR | 2001-110818 | A | 12/2001 |
| KR | 2002-67119 | A | 8/2002 |
| KR | 2003-38086 | A | 5/2003 |
| WO | WO 2005/022505 | | 3/2005 |

OTHER PUBLICATIONS

International Search Report dated Feb. 23, 2005 PCT/KR2004/002854 (listing 3 references).

European Search Report dated Aug. 1, 2008 issued in EP 04800042.6.

ACCESS.bus Specification Version 3.0—ACCESS.bus Industry Group—"Monitor Device Protocol Specification"—XP-002488014—Sep. 30, 1995.

* cited by examiner

DISPLAY SYSTEM

CROSS-REFERENCE TO RELATED APPLICATIONS

This application claims the benefit of Korean Patent Application No. 2004-3938, filed Jan. 19, 2004, in the Korean Intellectual Property Office, the disclosure of which is incorporated herein by reference.

BACKGROUND OF THE INVENTION

1. Field of the Invention

The present general inventive concept relates to a display system, and more particularly, to a display system to provide user-friendly graphic interfaces and information of controllable functions of a microcomputer used with a controller which outputs control instructions to control a display.

2. Description of the Related Art

A display, particularly a monitor, is an apparatus which receives horizontal and vertical synchronization signals (H/V Sync Signals) and image signals like R (Red), G (Green), B (Blue) signals from a computer graphic controller, and displays images.

Generally, a display for a monitor is a CDT (Color Display Tube) and a LCD (Liquid Crystal Display). A CDT, as a CRT (Cathode Ray Tube) for a monitor, a type of electronic tube, collects electrons emitted from a cathode sealed within the tube, accelerates the electrons to make electronic beams and controls the direction of the electrons by the action of the electronic field or the magnetic field. On the other hand, an LCD is a display which transforms molecular structures of liquid crystals by a voltage difference of two electrodes on two substrates inserted in the liquid crystals thereof, generates a brightness, and displays images.

A conventional display 120, as shown in FIGS. 1 and 2, comprises an interface unit 121 to receive image signals, a display unit 122 to show images, a signal processor 123 to convert the image signals inputted through the interface unit 121 to a signal being displayed by the display unit 122, an OSD (On Screen Display) generator 125 to generate OSD signals, an OSD handler 126 to generate key signals and a microcomputer (MICOM) 124 to control the interface unit 121, the display unit 122, the signal processor 123, the OSD generator 125 and the OSD handler 126. Here, the OSD handler 126 comprises an OSD control button **126*b* provided in the front of a display device 140, and a key signal generator 126*a* of the OSD control button 126*b*. Accordingly, when a user handles the OSD control button 126*b*, the key signal generator 126*a* transmits the key signals corresponding to the key handling to the MICOM 124, and the MICOM 124 controls the OSD generator 125 according to the key signals transmitted from key signal generator 126*a* to show an OSD display on the display unit 122**. Accordingly, an image display state, such as a brightness, a contrast, a size, or the like is adjusted.

However, the conventional display 120 has some problems in adjusting the image display state.

First, to adjust an image display state, the display 120 needs another component such as the OSD generator 125, the OSD handler 126, or the like.

Second, the display 120 comprises a data storage such as an EEPROM in which data for the composition of the OSD picture and programs are stored. However, this data storage provided in the display 120 has limitations in the size of data for the composition of the OSD picture and programs because of a storage capacity. This makes the composition of the OSD picture simple, and the simple OSD picture cannot provide enough information related to the adjustment of an image display stage for users. Thus, the conventional display 120 should provide a manual about the method of an OSD handling and the adjustment of an image display stage using the OSD. Further, users should refer to the manual for the adjustment of a display stage of the display 120.

Third, the OSD control button **126*b* is provided in the front of the display 120, so that the number of OSD control buttons that can be provided is limited because of a space problem. When users adjust the display state of the display 120**, they should make several key handlings, which results in an inconvenience to the users.

Accordingly, to solve the problems described above, if a computer having a larger storage capacity than a display is provided, resulting in increased convenience to the user's handling of the computer, which increases the user's control of an image display state, a user-friendly graphic interface of an image display adjustment can be provided.

SUMMARY OF THE INVENTION

Accordingly, it is an aspect of the general inventive concept to provide a display system that provides a user-friendly graphic interface for users.

It is another aspect of the general inventive concept to provide a display system that provides information of controllable functions of a display for a controller like computers, or the like.

Additional aspects and advantages of the general inventive concept will be set forth in part in the description which follows and, in part, will be obvious from the description, or may be learned by practice of the invention.

The foregoing and/or other aspects of the general inventive concept can be achieved by providing a display system including: a display having an interface unit to provide bi-directional communication, an image display unit to show an image, a signal processor to convert an image signal inputted through the interface unit to a signal being displayed by the display unit, and an MICOM to output display information of controllable functions over the image display unit and the signal processor through the interface unit; and a controller connected to the interface unit, the controller providing a graphic user interface corresponding to the display information received from the display and having a display controller to output control instructions to the MICOM through the interface unit that allows the MICOM to control at least one of the display unit and the signal processor according to a setting through the graphic user interface.

According to an aspect of the general inventive concept, the interface unit may support a display data channel-command interface (DDC-CI).

According to another aspect of the general inventive concept, the controller outputs the image signal to the display through the interface unit.

According to another aspect of the invention, the display controller may provide the graphic user interface being set up with the control instructions able to be controlled by the MICOM for the display, based on the display information.

According to yet another aspect of the general inventive concept, the display information may include information on a display type, and the display type may include one of an LCD, a CRT and a DLP.

According to yet another aspect of the general inventive concept, the display information may include information on a graphic interface type of the interface unit, and the graphic interface type is one of an analog interface and a digital interface.

According to yet another aspect of the general inventive concept, the analog interface may include a D-SUB interface, and the digital interface may include a DVI interface.

According to still another aspect of the general inventive concept, the display information may include information of an MICOM changeable service menu.

According to still another aspect of the general inventive concept, the display controller can request the display to transmit the display information when the display is connected to the interface unit, and the MICOM can transmit the display information to the controller according to the request of the display controller.

BRIEF DESCRIPTION OF THE DRAWINGS

These and/or other aspects and advantages of the general inventive concept will become apparent and more readily appreciated from the following description of the preferred embodiments, taken in conjunction with the accompanying drawings of which.

DETAILED DESCRIPTION OF THE PREFERRED EMBODIMENTS

Figure 1:
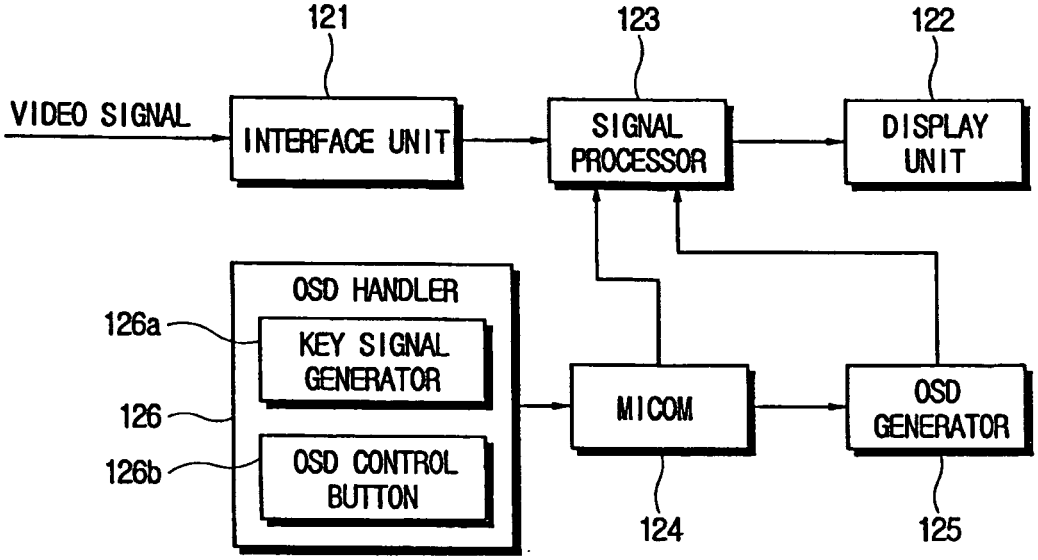
FIG. 1 (PRIOR ART)
FIG. 1 is a control block diagram of a conventional display.

Reference will now be made in detail to the present embodiments of the general inventive concept, examples of which are illustrated in the accompanying drawings, wherein like reference numerals refer to the like elements throughout. The embodiments are described below in order to explain the general inventive concept by referring to the figures.

Figure 3:
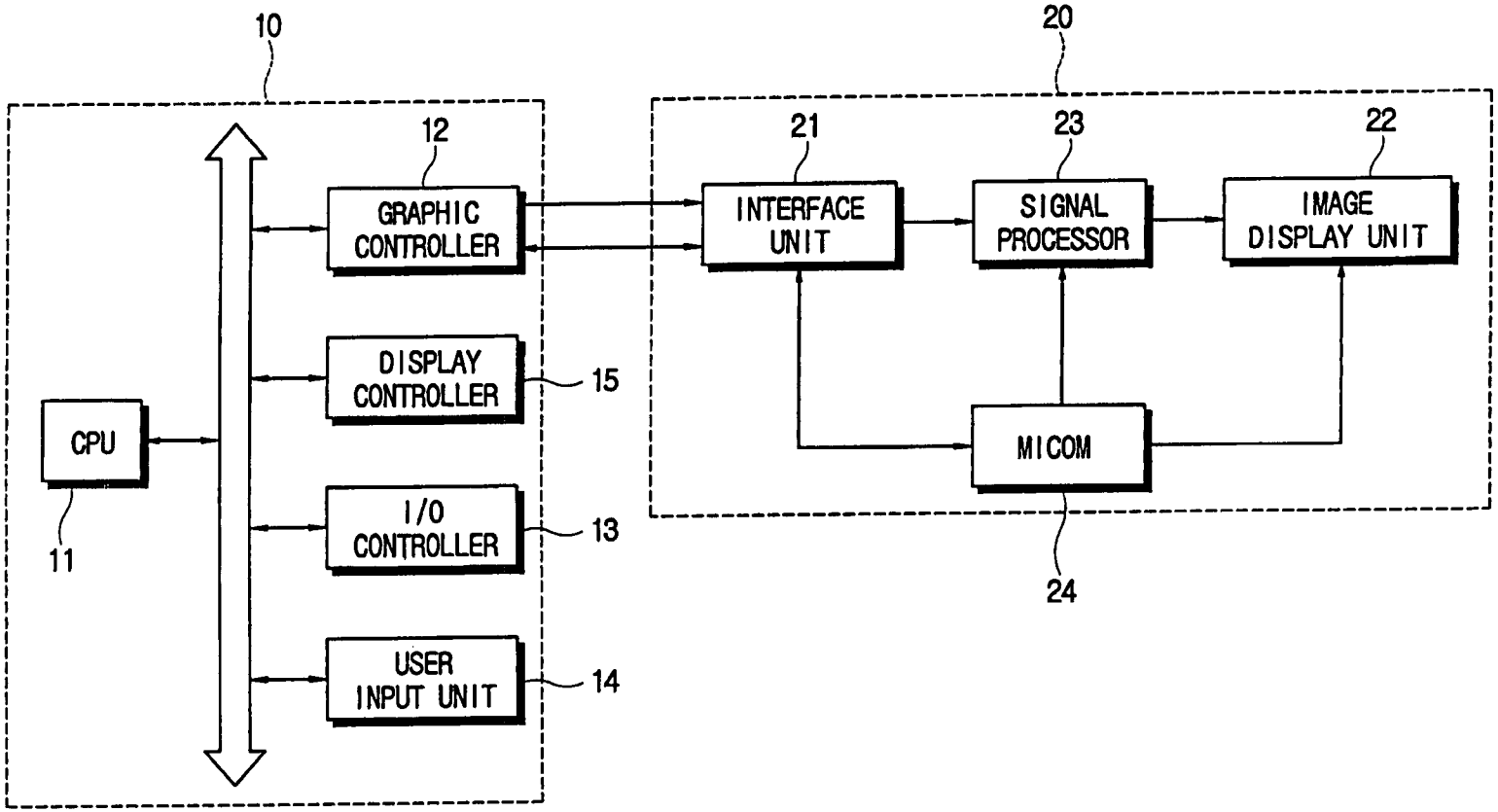
FIG. 3 is a control block diagram of a display system according to an embodiment of the present general inventive concept.

As shown in FIG. 3, a display system according to an embodiment of the general inventive concept includes a controller 10, and a display 20 to receive control instructions from the controller 10 and to execute functions of the display 20. Here, the controller 10 according to an embodiment of the general inventive concept can apply an image signal to the display 20 as illustrated, as an example. However, the general inventive concept is not limited thereto, for example, the controller 10 may include other apparatuses connected to the display 20 through a bidirectional communicable interface without regard to its present state.

The controller 10, such as a computer, according to this embodiment of the general inventive concept, includes a CPU (Central Processing Unit) 11, a graphic controller 12 that can output the image signal to the display 20, a user input unit 14, such as a keyboard, a mouse or the like, an I/O (Input/Output) controller 13 connected to the user input unit 14 that can process the user input signals inputted from the user input unit 14, a display controller 15 to output the control instructions to the display 20 and a system bus to connect each of the above listed items mutually.

The display controller 15 can provide a graphic user interface to set an image display stage. The display controller 15 according to this embodiment can be an application program installed in the controller 10 (or computer) and can act as an operating system of the controller 10, but is not limited thereto. Here, the display controller 15 can output control instructions according to a user's setting(s) through the graphic user interface.

Moreover, the display controller 15 according to this embodiment can receive display information from the display 20 and can provide the graphic user interface corresponding to the received display information. Here, the display controller 15 decides which functions can be controlled by an MICOM 24 of the display 20 based on the received display information and can provide the graphic user interface, which can be set up with only the control instructions that are able to be controlled by the MICOM 24. For example, when display controller 15 determines that the MICOM 24 of the display 20 doesn't support a resolution adjustment function based on the display information, the display controller 15 can cause the buttons for resolution adjustment, provided in the graphic user interface, to be disabled. Here, the display information from the display 20 will be set forth below.

The display controller 15 can transmit the control instructions corresponding to user's handling to the MICOM 24 through aninterface unit 21 of the display 20 when the user handles the graphic user interface through the user input unit 14. In this case, the MICOM 24 can control a signal processor 23 and an image display unit 22 to change an image display state, based on the received control instructions, through the interface unit 21. Accordingly, the image display state can be adjusted through the user input unit 14, such as a mouse, etc., of the controller 10, so that a more convenient user interface can be provided.

Meanwhile, the display 20 according to this embodiment includes the interface unit 21, which can be connected with the graphic controller 12 of the controller 10 and can receive the image signals, the signal processor 23 to convert the image signal inputted through the interface unit 21 to a signal available to be displayed by the display unit 22, and the MICOM 24 to control each of these items within the display.

The interface unit 21 can receive the image signals from the graphic controller 12 of the controller 10. The image signals from the graphic controller 12 can include R (Red), G (Green), B (Blue) signals and horizontal and vertical synchronization signals (HN Sync Signals). Here, the interface unit 21 can be one of various types of interface units that can be connected with the graphic controller 12 of the controller 10 (or computer), such as, for example, a D-SUB connector or a DVI connector.

Moreover, the interface unit 21 according to this embodiment can provide a bi-directional communication interface. Thus, the controller 10 may transmit data, as well as the image signals to the display 20. Further, the display 20 can transmit the various information of the display 20 to the controller 10. The interface unit 21 can support a display data channel (DDC) function to communicate bidirectionally with the controller 10. The DDC function of this embodiment may be a DDC-DI interface, but is not limited thereto. As stated above, the interface unit 21 may be one of several types of interface units, such as a USB interface and the like. The DDC function is a type of standard provided by VESA (Video Electronics Standard Association) for auto setup, i.e., Plug and Play in a display system, and defines signal lines and their sequences in exchanging data between the controller 10 and the display 20. Hereinafter, the interface unit 21 will be understood as being able to support the DDC functions as an example, and accordingly, the MICOM 24 of the display 20 can exchange data with the controller 10 through a DDC communication line.

Figure 4:
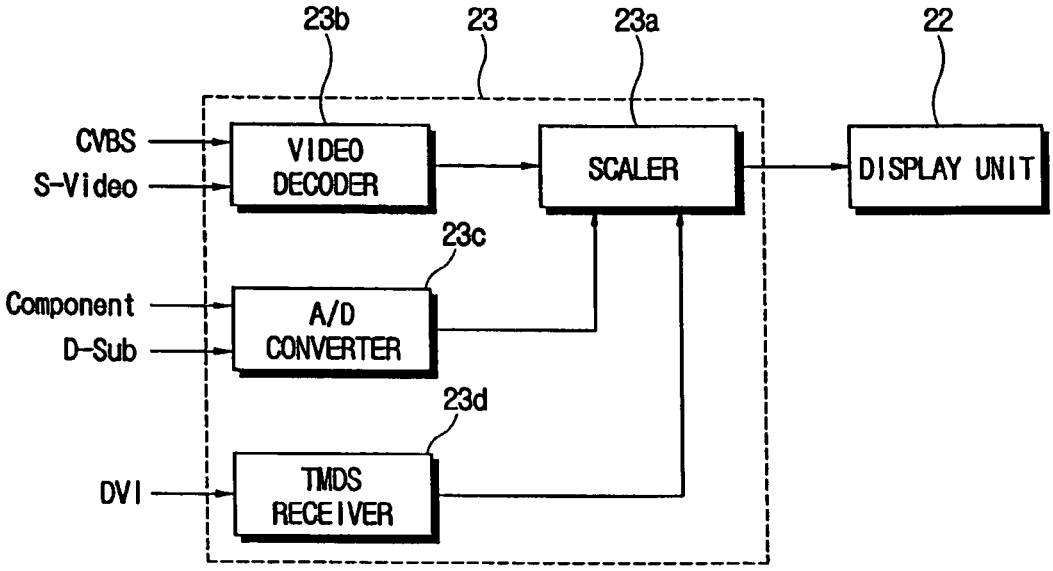
FIG. 4 is a control block diagram of a signal processor of FIG. 3.

The image display unit 22 of the display 20 and the signal processor 23 according to this embodiment may be provided in various forms in accordance with the type of the display 20. For example, if the display 20 according to this embodiment is an LCD, the signal processor 23 may include an AND converter 23*c* (see FIG. 4) to convert horizontal/vertical synchronization signals, and R, G, and B images inputted through the interface unit 21 to digital image signals, and a scaler 23*a* (see FIG. 4) to scale the digital image signals from the AND converter 23*c* (see FIG. 4). If the display 20 according to this embodiment is an LCD display, the display 20 may include an LCD panel to show images, a panel driver to drive the LCD panel and a back light unit to provide lights for the LCD panel. On the other hand, if the display 20 is a CRT, the signal processor 23 may include an amplifier to amplify the image signals inputted through the interface unit 21, a vertical deflector and a horizontal deflector to deflect electronic beams, based on a horizontal and vertical synchronization communication line. For example, when the MICOM 24 controls the image display unit 22 and/or the signal processor 23 to adjust an image display state shown on the image display unit 22, the MICOM 24 can inform the controller 10 regarding the information of controllable functions, for example, brightness, contrast, position, size and the like.

As the controllable functions by the MICOM 24 may be different in accordance with the type of the display 20 being used, it is an aspect that the display information includes information of the type of the display 20. The type of the display 20 being used may be one of a DLP (digital light processing), the LCD, a PDP (plasma display panel) and the CRT (cathode ray tube). Accordingly, the display controller 15 can determine the MICOM controllable functions based on the information of the type of the display 20 included in the display information. For example, if the type of the display 20 being used is the CRT, a button to adjust resolution may be disabled on the graphic user interface since resolution adjusting is not supported by a CRT. On the other hand, if the type of the display 20 being used is the LCD, since functions such as a Trapezoid, Parallelogram, Pin cushion, Pin balance, Rotation, Degausing and Moire, and the like, are supported only by the CRT, the display controller 15 will disable the buttons for these functions.

The display information may include the type of the graphic interface of the interface unit 21. Generally, as digital image signals inputted through the digital interface have exact color value and position value, the MICOM 24 doesn't adjust the color or the position of the image. Also, the MICOM 24 of the specific display 20 doesn't adjust Contrast, Fine and Coarse for digital image signals and doesn't execute an Auto Adjustment function. Here, the MICOM 24 can sense whether the controller 10 is connected with an analog interface such as a D-SUB interface, or a digital interface such as a DVI interface, as the interface unit 21, and can provide the display information including information for the controller 10 through the pertinent interface unit 21. Here, it is an aspect of the general inventive concept that the MICOM 24 defines the information of controllable functions over the analog interface and the digital interface, respectively, and outputs that information to the display controller 15.

Figure 5:
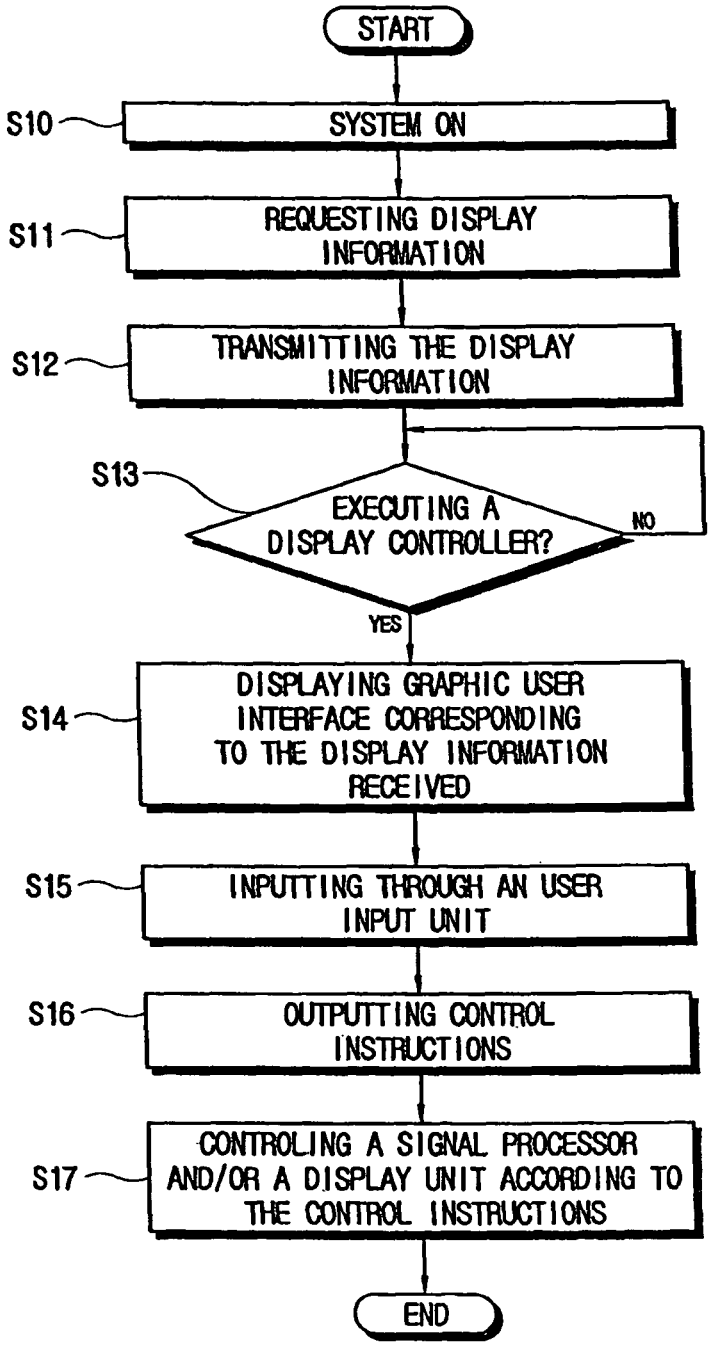
FIG. 5 is a control flow chart of the display system according to another embodiment of the present general inventive concept.

Referring to FIG. 5, a description of a control process of the display system according to the embodiment of FIG. 3 follows.

First, when a power is applied to the controller 10 and the display 20, being connected to each other, at operation S10, the display controller 15 of the controller 10 requests a transmission of the display information to the display 20 through the DDC communication line, at operation S11.

Next, at operation S12, when there is the request from the display controller 15, the MICOM 24 outputs the display information to the display 20 through the DDC communication line. Here, the display information can include the type of the display 20 and the type of the graphic user interface connected with the controller 10 requesting the display information.

Then, display controller 15 can check the MICOM 24 controllable functions based on the display information received from the display 20. When a user selects the execution of the display controller 15 at operation S13, the display controller 15 can output the image signals, to make the graphic user interface correspond with the display information displayed on the interface unit 21, to the display 20, at operation S14. In this case, the graphic user interface is displayed, and only the buttons for the MICOM controllable functions will be activated.

Here, when a user handles the user input unit 14, such as the mouse or the like, at operation S15, the display controller 15 can output a control instruction corresponding to the user's handling through the DDC communication line to the MICOM 24 at operation S16, and the MICOM 24 can control the display unit 22 and/or the signal processor 23 on the basis of the control instruction from display controller 15, at operation S17.

Meanwhile, the controller according to this embodiment may be a portable terminal, such as a portable computer having a service menu of display manufacturers, a PDA or the like. Here, the display controller 15 according to this embodiment can be provided in the portable terminal and can request the display information including a service menu available to be changed by the MICOM 24 when the portable terminal service menu is connected to the display 20. Here, the service menu refers to some functions that can be adjusted by a service man or the manufacturer, and may not be adjusted by a common consumer of the display 20. For example, the service menu may refer to adjusting the number of times panels are exchanged, a use time, Auto Color and Factory Reset and the like, for an LCD. Also, the MICOM 24 may provide the display information including information of the changeable service menu that can be changed by the MICOM 24 on the basis of the display information that is activated.

Figure 2:
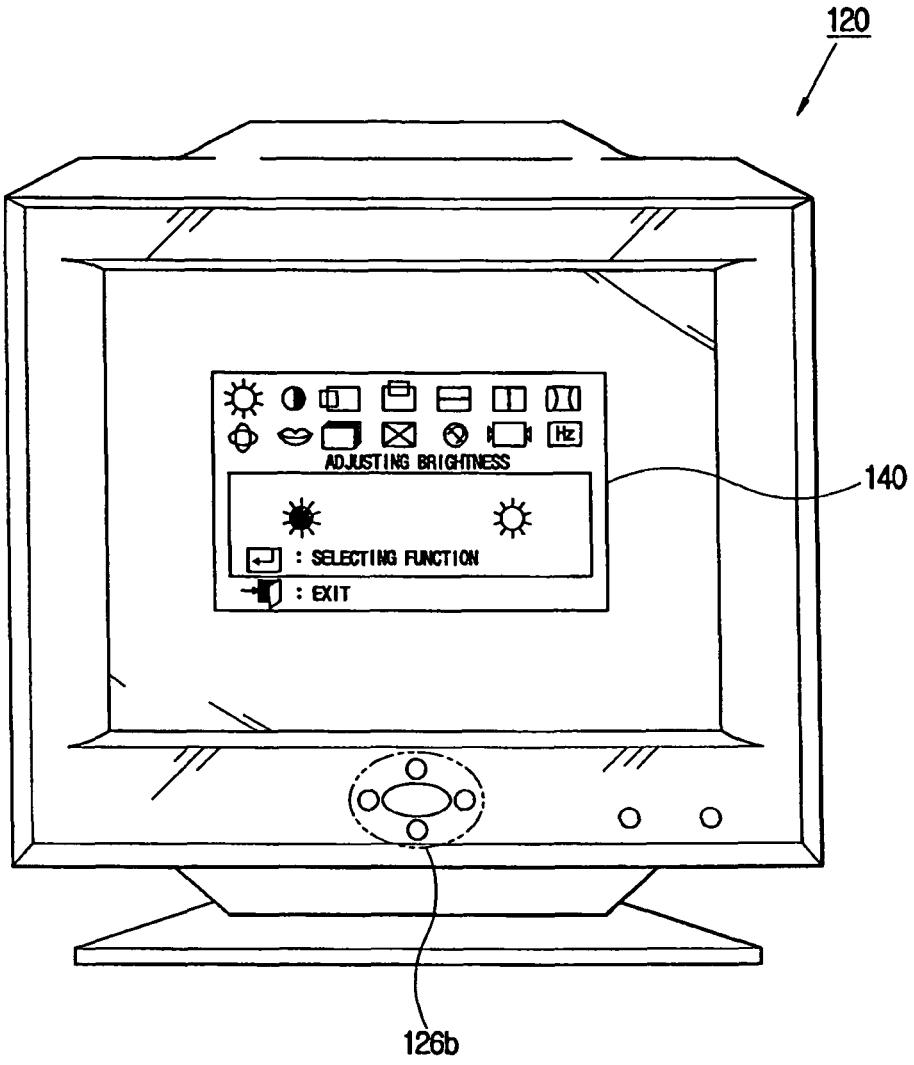
FIG. 2 (PRIOR ART)
FIG. 2 is a front view of the conventional display of FIG. 1 showing a conventional OSD picture.

Further, although the type of the graphic user interface provided by the display controller 15 in FIG. 3 has not been described in detail, it may include much more information than the graphic user interface under the conventional OSD settings described in FIG. 2, so that a user can receive the right information required to adjust the image display state through the graphic user interface without special manuals. Here, the graphic user interface is provided by the display controller 15 installed in the controller 10, such as a computer and the like, so that problems relating to the storage capacity and the handling problems under the conventional OSD setting can be overcome.

The display controller 15 can provide the graphic user interface on which only the buttons for the controllable functions by the MICOM 24, based on the display information, are activated in the above embodiment, but is not limited thereto. That is, various graphic user interfaces may be provided according to the type of the display 20, such as the LCD, the CRT and the like. In these cases, the buttons to adjust the Trapezoid, Parallelogram, Pin cushion, Pin balance, Rotation, Deguassing, Moire, and the like, are not provided for the LCD graphic user interface, and the button to adjust the resolution is not provided for the CRT graphic user interface.

As described above, the interface unit 21 to provide bidirectional communication, the image display unit 22, the signal processor 23, the display 20 having the MICOM 24 and the controller 10 connected to the interface unit 21 are provided so that a graphic user interface that is user-friendly and can be set up with functions that can be controlled by the display 20 being used, can be provided.

As described above, the general inventive concept also provides a display system in which a graphic user interface that is user-friendly and can be set up with functions controllable by the MICOM of the display, can be provided.

Although a few embodiments of the general inventive concept have been shown and described, it would be appreciated by those skilled in the art that changes may be made in this embodiment without departing from the principles and spirit of the invention, the scope of which is defined in the claims and their equivalents.

What is claimed is:

1. A display system comprising:

a display unit, including a microprocessor, having an interface unit to perform bi-directional communication, an image display unit to show an image, a signal processor to convert an image signal inputted through the interface unit to a signal being displayed by the display unit, the microprocessor to output display information of controllable functions of the image display unit and the signal processor through the interface unit to an external controller; and the external controller connected to the interface unit and directly providing, in response to a request by the display unit, a graphic user interface corresponding to the display information for the display unit such that the graphic user interface is displayed on the image display unit, and having a display controller to output control instructions to the microprocessor through the interface unit that allows the microprocessor to control at least one of the image display unit and the signal processor according to a setting through the displayed graphic user interface, wherein a first button in the graphic user interface, which is configured to execute a first function which is controlled by the image display unit or the signal processor is activated, and wherein a second button in the graphic user interface is disabled, the second button being configured to execute a second function which is not controlled by the image display unit and the signal processor, wherein the external controller to provide the graphic user interface to the display unit is not controlled via the graphic user interface, but the display unit to receive the graphic user interface from the external controller is controlled via the graphic user interface, and wherein the display information comprises activated information of a microprocessor changeable service menu and an image display state.

2. The display system according to claim 1, wherein the interface unit comprises a DDC-CI interface.

3. The display system according to claim 1, wherein the controller outputs the image signal to the display unit through the interface unit.

4. The display system according to claim 3, wherein the display controller causes the graphic user interface to be set up with the control instructions that are controlled by the microprocessor for the display unit, based on the display information.

5. The display system according to claim 3, wherein the display information comprises information on a display type, and the display type comprises one of an LCD, a CRT and a DLP display.

6. The display system according to claim 4, wherein the display information comprises information on a graphic user interface type of the interface unit, and the graphic user interface type is one of an analog interface and a digital interface.

7. The display system according to claim 6, wherein the graphic user interface is an analog interface comprising a D-SUB interface.

8. The display system according to claim 6, wherein the graphic user interface is a digital interface comprising a DVI interface.

9. The display system according to claim 5, wherein the display information comprises information on a graphic interface type of the interface unit, and the graphic interface type is one of an analog interface and a digital interface.

10. The display system according to claim 9, wherein the analog interface comprises a D-SUB interface, and the digital interface comprises a DVI interface.

11. The display system according to claim 1, wherein the display controller requests the display unit to transmit the display information when the display unit is connected to the controller through the interface unit, and the microprocessor transmits the display information to the controller according to a request of the display controller.

12. The display system according to claim 1, wherein the display controller requests the display unit to transmit the display information when the display unit is connected to the interface unit, and the microprocessor transmits the display information to the controller according to the request of the display controller.

13. The display system according to claim 1, wherein the controller is a portable computer including a service menu of a display manufacturer including functions that are adjusted and include a number of times panels are exchanged, a use time, and Auto Color and Factory Reset for an LCD.

14. A display apparatus comprising:

a display unit, including a microprocessor, to convert an image signal and to display an image corresponding to the image signal;

a bi-directional interface unit; and an external controller to receive a graphic user interface request from the display unit and display information of controllable functions of the display unit from the display unit through the bi-directional interface unit, and to directly provide a graphic user interface corresponding to the display information for the display unit such that the graphic user interface is displayed on the display unit together with control instructions to control the display unit through the displayed graphic user interface, wherein a first button in the graphic user interface, which is configured to execute a first function which is controlled by the display unit is activated, and wherein a second button in the graphic user interface is disabled, the second button being configured to execute a second function which is not controlled by the display unit, wherein the external controller to provide the graphic user interface to the display unit is not controlled via the graphic user interface, but the display unit to receive the graphic user interface from the external controller is controlled via the graphic user interface, and wherein the display information comprises activated information of a microprocessor changeable service menu and an image display state.

15. The display apparatus according to claim 14, wherein the external controller comprises a user input unit to generate the control instructions to control the controllable functions of the display unit.

16. The display apparatus according to claim 14, wherein the display information includes information on a display unit type, and the display unit type comprises one of an LCD, a CRT and a DLP display unit.

17. A method of controlling a display unit by a controller external to the display unit which has an image display unit and a microprocessor, comprising:

requesting, by the display unit, a graphical user interface from the external controller, requesting, by the external controller, display information from the display unit; and directly providing, by the external controller, a customized graphic user interface corresponding to the received display information for the display unit such that the customized graphic user interface is displayed on the display unit together with control instructions to control the display unit through the displayed customized graphic user interface, wherein a first button in the graphic user interface, which is configured to execute a first function which is controlled by the display unit is activated, wherein a second button in the graphic user interface is disabled, the second button being configured to execute a second function which is not controlled by the display unit, wherein the controller to provide the customized graphic user interface to the display unit is not controlled via the customized graphic user interface, but the display unit to receive the customized graphic user interface from the controller is controlled via the customized graphic user interface, and wherein the display information comprises activated information of a microprocessor changeable service menu and an image display state.

18. The method according to claim 17, wherein the display information includes the type of display being used.

19. The method according to claim 17, wherein the graphic user interface displays only controllable functions related to a current display unit being used.

20. A display system comprising:

a controller, external to a display unit that has a microprocessor, the controller containing plural graphic user interfaces corresponding to respective display units, and which outputs, in response to a request from at least one of the respective display units, one of the plural graphic user interfaces to be displayed according to display information to the display units such that the graphic user interface is displayed on at least one of the display units, and outputs control instructions to control the display units through the displayed graphic user interface, wherein a first button in one of the plural graphic user interfaces, which is configured to execute a first function which is controlled by the corresponding display unit is activated, and wherein a second button in one of the plural graphic user interfaces is disabled, the second button being configured to execute a second function which is not controlled by the corresponding display unit, wherein the controller to provide the graphic user interface to the display unit is not controlled via the graphic user interface, but the display unit to receive the graphic user interface from the controller is controlled via the graphic user interface, and wherein the display information comprises activated information of a microprocessor changeable service menu and an image display state.

21. The display system of claim 20, wherein the display information includes information about the display unit type, and the display unit type comprises one of an LCD, a CRT and a DLP display unit.

22. A method of controlling a display apparatus having a microprocessor comprising:

requesting a graphic user interface by the display apparatus;

directly providing display information to an external device from the display apparatus through a bi-directional interface unit; and receiving a graphic user interface from the external device through the bi-directional interface unit, the graphic user interface corresponding to the display information from the external device such that the graphic user interface is displayed on the display apparatus and has control instructions to control the display apparatus according to a setting through the displayed graphic user interface, wherein a first button in the graphic user interface, which is configured to execute a first function which is controlled by the display apparatus is activated, and wherein a second button in the graphic user interface is disabled, the second button being configured to execute a second function which is not controlled by the display apparatus, wherein the external device to provide the graphic user interface to the display is not controlled via the graphic user interface, but the display apparatus to receive the graphic user interface from the external device is controlled via the graphic user interface, and wherein the display information comprises activated information of a microprocessor changeable service menu and an image display state.

23. The method of claim 22, wherein the external device is a personal computer.

24. A display apparatus comprising:

an image display unit to display an image; and an interface unit to bi-directionally communicate with an external device;

a signal processor to convert a signal inputted through the interface unit to the image being displayed by the image display unit; and a controller within the image display unit to request a graphical user interface from the external device, to provide display information of controllable functions of the image display unit to the external device, and to receive a graphic user interface corresponding to updated display information from the external device such that the graphic user interface is displayed on the image display unit corresponding to control instructions to control the image display unit through the interface unit from the external device in accordance with the controllable functions, wherein a first button in the graphic user interface, which is configured to execute a first function which is controlled by the controller within the image display unit or the signal processor is activated, and wherein a second button in the graphic user interface is disabled, the second button being configured to execute a second function which is not controlled by the controller of the image display unit and the signal processor, wherein the external device to provide the graphic user interface to the display apparatus is not controlled via the graphic user interface, but the display apparatus to receive the graphic user interface from the external device is controlled via the graphic user interface, and wherein the display information comprises activated information of a controller changeable service menu and an image display state.

25. The display apparatus of claim 24, wherein the external device is a personal computer.

26. The display system according to claim 1, wherein the displayed graphic user interface is adapted to a type of the display.

27. A method of controlling a display apparatus that has a microprocessor, comprising:

communicating, by an external controller, control instructions to the display apparatus in response to a graphical user interface request by the display apparatus;

sending, by the display apparatus, display information indicative of the display apparatus to the external controller in response to communicating the control instructions to the display apparatus;

determining, by the external controller, a graphic user interface based on the display information;

sending control instructions and the graphic user interface from the external controller to the display apparatus; and displaying the graphic user interface via the display apparatus to control the display apparatus, wherein the external controller to send the graphic user interface to the display apparatus is not controlled via the graphic user interface, but the display apparatus to receive the graphic user interface from the controller is controlled via the graphic user interface, wherein a first button in the graphic user interface, which is configured to execute a first function which is controlled by the display apparatus or a signal processor of the display apparatus is activated, and wherein a second button in the graphic user interface is disabled, the second button being configured to execute a second function which is not controlled by the display apparatus and the signal processor of the display apparatus, and wherein the display information comprises activated information of a microprocessor changeable service menu and an image display state.

28. The method of claim 27, wherein the determining the graphic user interface includes determining the graphic user interface from among a plurality of graphic user interfaces each corresponding with a different display apparatus based on the display information.

29. A display system comprising:

a display unit, including a microprocessor, to convert an image signal and to display an image having at least one adjustable image display state; and a controller external to a display unit, where the display unit requests a graphic user interface from the controller and the controller communicates with the display unit and receives display information from the display unit indicating a type of display unit in response to communicating with the display unit, where the controller outputs the graphic user interface to the display unit, based on the display information, to adjust the at least one adjustable image display state of the image, wherein the controller to send the graphic user interface to the display apparatus is not controlled via the graphic user interface, but the display unit to receive the graphic user interface from the controller is controlled via the graphic user interface, wherein a first button in the graphic user interface, which is configured to execute a first function which is controlled by an image display unit or a signal processor of the display unit is activated, and wherein a second button in the graphic user interface is disabled, the second button being configured to execute a second function which is not controlled by the image display unit and the signal processor of the display unit, and wherein the display information comprises activated information of a microprocessor changeable service menu and the at least one adjustable image display state.

30. The display system of claim 29, wherein the controller stores a plurality of graphic user interfaces each corresponding to a different display unit and outputs a graphic user interface corresponding to the display unit communicating with the controller based on the display information.

* * * * *